United States Patent [19]

Shaffer et al.

[11] 4,371,163

[45] Feb. 1, 1983

[54] BOWLER'S WRIST AND FINGER CONTROL DEVICE

[76] Inventors: Robert L. Shaffer, 10439 Greenview Rd., Columbia Station, Ohio 44028; Richard W. Heckman, 1170 Cahoon Rd., Westlake, Ohio 44145

[21] Appl. No.: 210,831

[22] Filed: Nov. 26, 1980

[51] Int. Cl.[3] ..... A63B 69/00

[52] U.S. Cl. ..... 273/54 B; 2/161 A

[58] Field of Search ..... 273/54 B, 189 A; 128/77, 87 R, 87 A, 89 R; 2/161 A

[56] References Cited

U.S. PATENT DOCUMENTS 3,467,379 9/1969 Kistner ..... 273/54 B
3,788,307 1/1974 Kistner ..... 128/77
4,176,840 12/1979 Lanning ..... 273/54 B
4,198,709 4/1980 Clayton ..... 273/54 B X

*Primary Examiner*—Anton O. Oechsle
*Attorney, Agent, or Firm*—Woodling, Krost & Rust

[57] ABSTRACT

A bowler's wrist and forefinger support which comprises a rigid body adapted to extend dorsally from the forefinger to a location on the forearm above the wrist. The distal portion of the support extends over and partially encases the forefinger throughout its entire length. The proximal portion is cylindrically curved to fit generally around the back of the hand, wrist and forearm. The support restricts backward movement of the forefinger to an optimal angular range of 15 to 20 degrees forward with respect to the axis of the hand.

1 Claim, 7 Drawing Figures

BOWLER'S WRIST AND FINGER CONTROL DEVICE

Our invention relates to apparatus for supporting the wrist and forefinger of a bowler in a desirable position.

BACKGROUND OF THE INVENTION

A primary objective in bowling is that the bowler impart to the ball a combination of two rotary motions, called "roll" and "spin".

Most bowlers experience great difficulty in giving both these types of rotation to the ball simultaneously in any consistent manner.

Various solutions have been proposed for the problem described. Some devices have been designed which affect or control the position of the bowler's fingers. These include the devices of U.S. Pat. Nos. 3,038,723; 3,152,337; 3,224,012; 3,362,027; 3,563,545, and 3,595,575. These devices are not in common use and they are not effective to achieve the aims discussed.

Other devices have been proposed which control or limit the bending of the wrist. Examples are those disclosed in U.S. Pat. Nos. 1,469,315; 2,794,638; 2,924,458; 3,117,786; 3,235,258; 3,423,095; 3,512,776; 3,606,342; 3,704,994; 3,788,307; 3,829,090; 4,088,318 and 4,176,840. Such devices are sometimes partially effective in assisting with the so-called "lift" and resulting roll, but do not provide a consistent spin at the same time.

Other wrist supports have been designed which also control the middle fingers, but these, described in U.S. Pat. Nos. 3,467,379; 3,726,525; 3,770,270 and 3,880,426 are similarly ineffective.

Our experiments have revealed the presumed function of these and other devices as well as the reason why they fail to achieve the desired results. It is necessary to support and control both the wrist and the angle of the index finger, as will be seen below. Our invention, in providing both kinds of support, is effective in assisting the bowler to impart the desired combination of roll and spin to the ball in a consistent manner.

SUMMARY OF THE INVENTION

An object of this invention is to provide a wrist and finger support which enables a bowler to give a desired combination of two types of rotary motion to the bowling ball.

A further object of this invention is to provide such a support which is adjustable to the dimensions of the individual user but which can be rapidly fitted to the user and removed.

These and other objects and advantages of our invention will become apparent from the following detailed description wherein reference is made to the figures in the accompanying drawings showing a preferred embodiment of the present invention, and illustrating the use thereof.

DESCRIPTION OF THE PREFERRED EMBODIMENT

Figure 1:
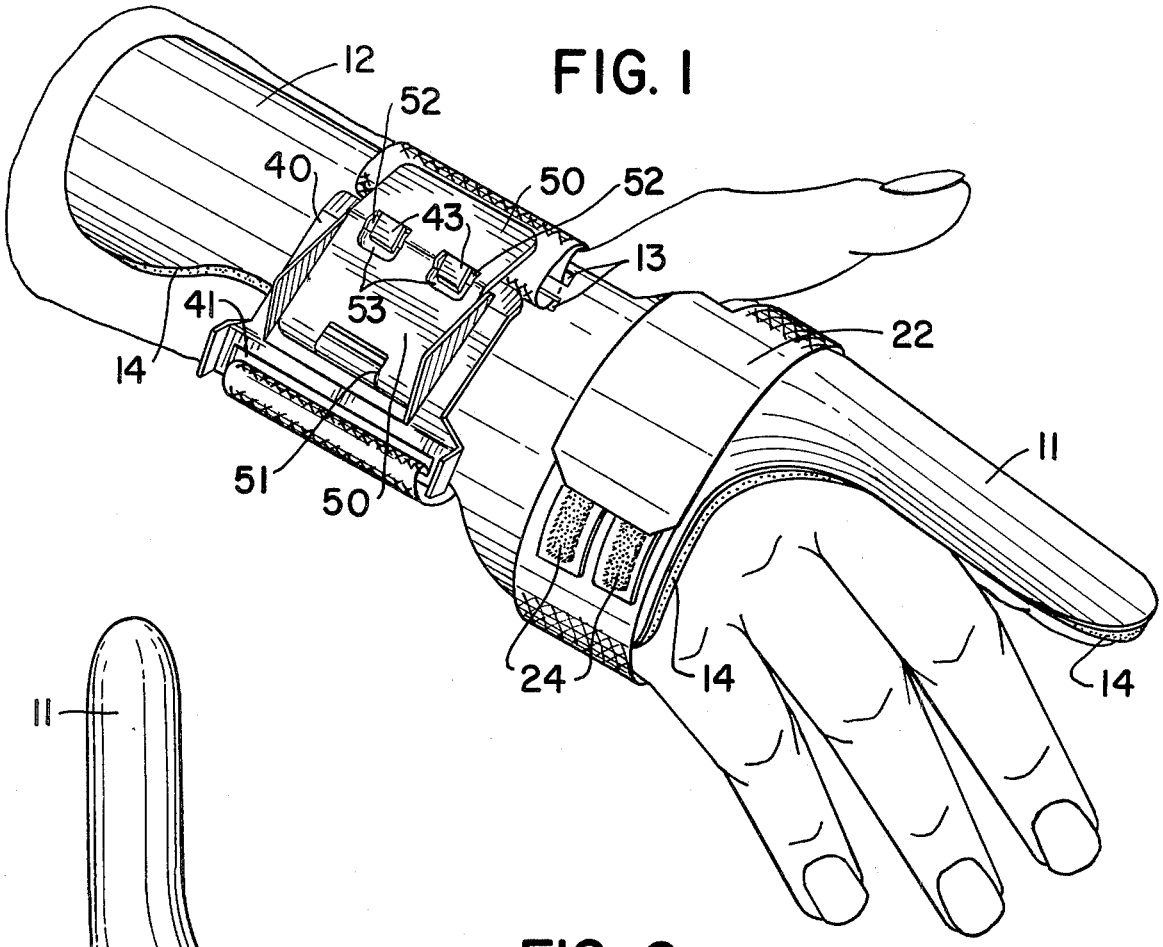
FIG. 1 is a perspective view of the wrist and finger support of our invention, in position on the arm of a user.
Figure 2:
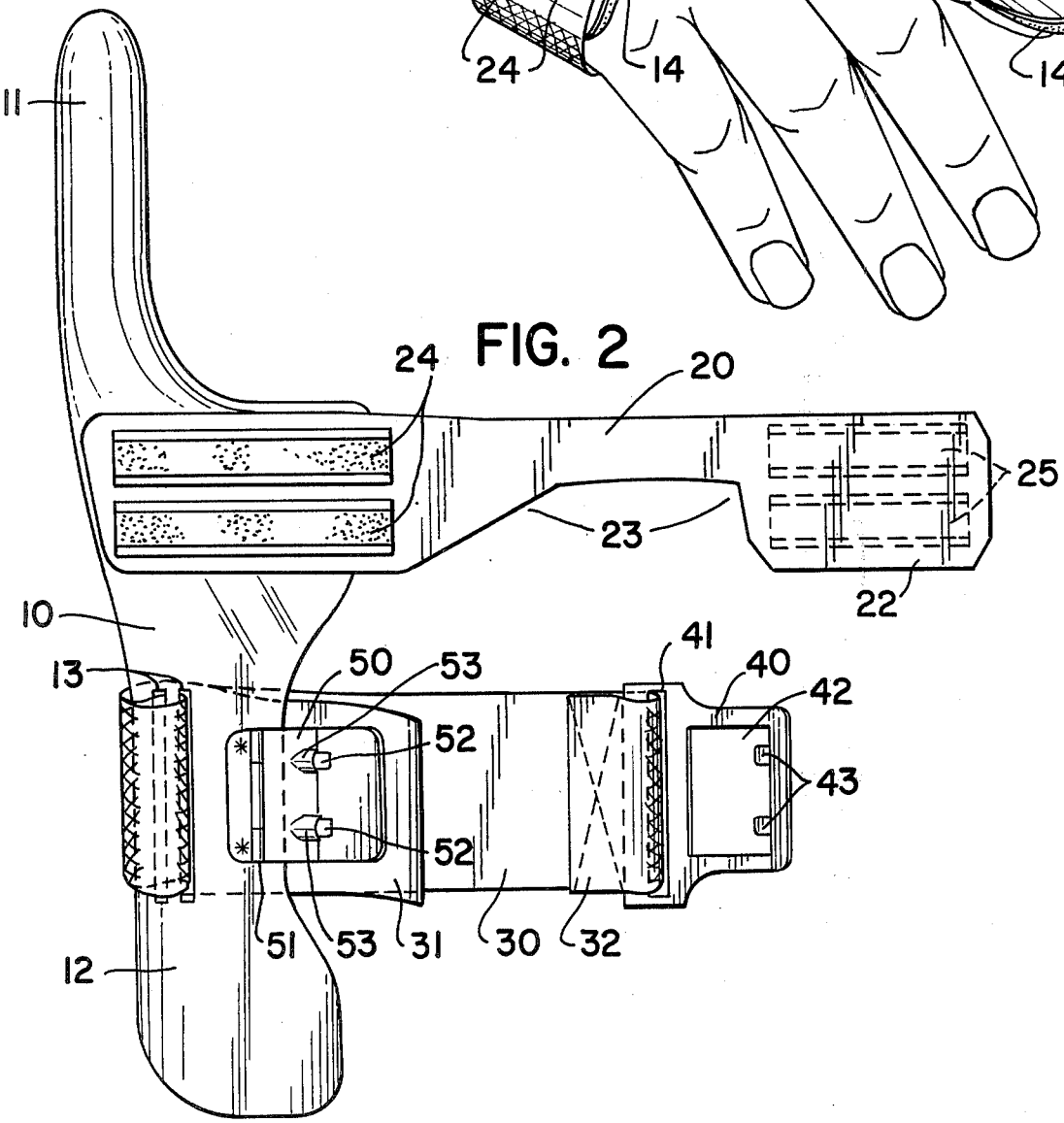
FIG. 2 is a plan view of our invention.
Figure 3:
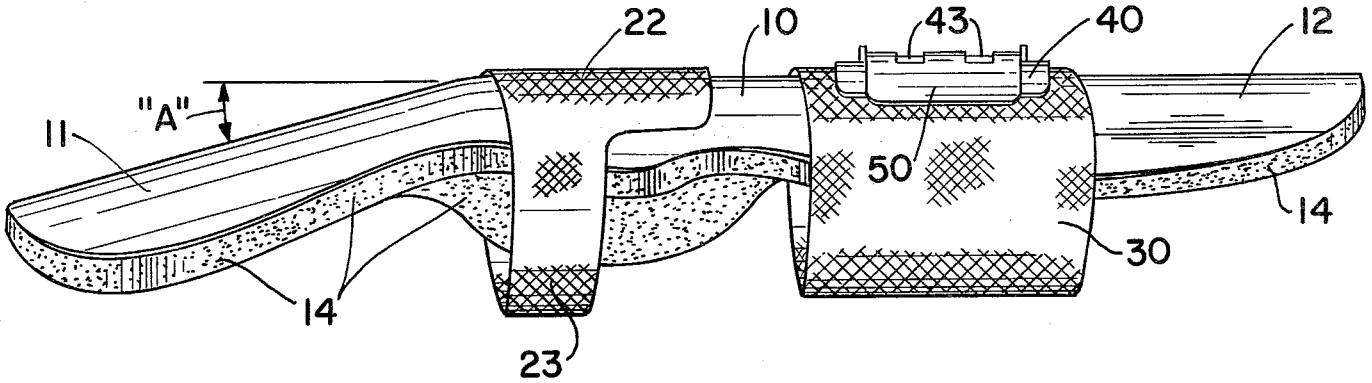
FIG. 3 is a side elevational view of our invention.

The preferred embodiment of our invention is seen in FIGS. 1, 2 and 3. It comprises a support body 10, of any strong rigid material, such as aluminum having permanently fastened thereon a hand supporting strap 20, and having adjustably fastened thereupon, by threading through slots 13 in said support body 10 a wrist supporting strap 30.

The support body 10 is a flat plate constructed so as to curve in a generally cylindrical way around the axes of the forearm, wrist and forefinger of the user so that these body members are accommodated comfortably. At its distal end is a forefinger extension 11, which is proportioned to extend and partially encase over the dorsal surface of the user's forefinger along its entire length (see FIG. 1), and at its proximal end is a forearm extension 12 which is proportioned to extend over a portion of the dorsal surface of the user's forearm. The entire ventral surface of the support body 10 is covered with a resilient layer 14 of material such as sponge or foam rubber.

The cylindrical axis of curvature of forefinger extension 11 is preferably not parallel to the cylindrical axis of curvature of the support body 10 but is at a slight angle "A" to it, so that the user's forefinger is supported in a slightly bent position. We have found that for most users the optimal angle is approximately 15 to 20 degrees downward toward the palm; however, it is contemplated that for particular users the optimal angle may vary from 0 to 35 degrees, and it is within the scope of the present invention to provide by any standard hinge and lock arrangement, well known to those skilled in the art, for an adjustable angle between support body 10 and forefinger extension 11. Similarly, though the wrist should ordinarily be supported by our device with only a minimal forward bend of between 0 and 5 degrees, provision may be made for an adjustable joint at the wrist which locks the supported angle between the forearm and hand axes at any desired angle between 10 degrees upward, (backward) and 20 degrees downward (forward).

It may be desirable in some cases to provide the forefinger extension 11 with a slight upward bend on its distal end. This provides for the angle "A" to be maximized while still permitting the user's hand to be close enough to the ball to hold it.

Two slots 13 are provided in the support body 10. They are located so as to be directly over the wrist area of the user while the device is properly worn. The support body 10 bears a hinge 51 adjacent to the slots 13 by which is fastened a male buckle member 50. The male buckle member is permitted by hinge 51 to lie in its closed position over the support body 10 and wrist support strap 30. It is provided with two tabular slots 52 each of which is adjacent to an indent 53.

The wrist support strap 30 is composed of any strong flexible material such as nylon webbing. It is in the shape of a lengthwise band having a first end 31 and a second end 32. The first end 31 is threaded through slots 13 and left free, so that the ultimately effective length of wrist support strap 30 is adjustable. The second end 32 is threaded through a single buckle slot 41 located upon a female buckle member 40, and is permanently fastened to the wrist support strap 30, as by sewing so that the female buckle member 40 is permanently fastened to the wrist support strap 30. The female buckle member 40 contains an opening 42 therein of such dimensions as to permit permit the insertion therethrough of male buckle member 50. On one edge of the opening 42 and projecting generally toward the opening are two tabs 43, disposed to fit into the two tabular slots 52 when the male buckle member 50 is inserted into the female buckle member 40 and rotated by means of hinge 51 to its closed position.

The hand supporting strap 20 is composed of a material of characteristics similar to the wrist support strap 30. It has a first end portion 21 permanently fastened by any suitable means to the portion of the support body 10 which in use overlies essentially the entire dorsal surface of the user's hand. It has a second end portion located at a distance from the first end 21 approximately equal to the circumference of a typical hand, and a narrowed portion 23 intermediate the ends so that the hand supporting strap 20 may be wrapped comfortably around the hand with the second end portion 22 overlying the first end portion 21. The top surface of the first end portion 21 and the bottom surface of the second end portion 22 are preferably provided with corresponding Velcro* tapes 24 and 25, respectively, so that the effective length of the hand supporting strap 20 is adjustable to the circumference of the user's hand.

*Trademark

Figure 4:
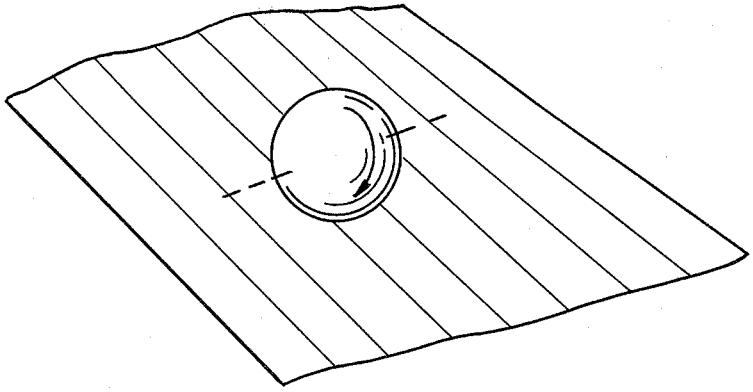
FIG. 4 is a perspective view of a bowling ball upon a bowling alley, engaged in the rotary motion called "roll".
Figure 5:
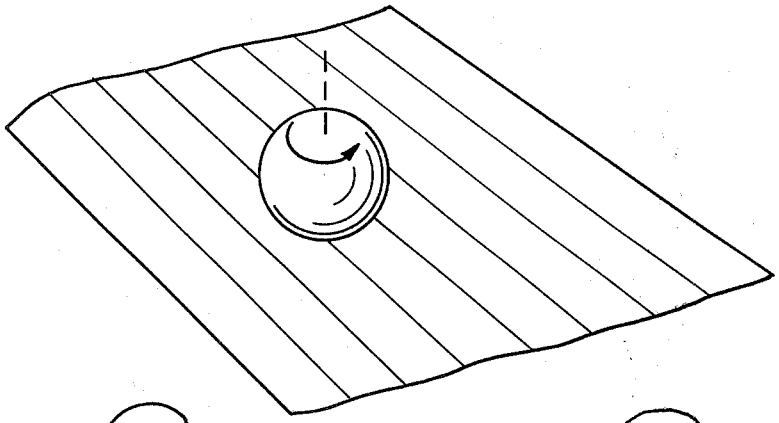
FIG. 5 is a perspective view of a bowling ball upon a bowling alley, engaged in the rotary motion called "spin".

The method of using our invention will become apparent upon consideration of the general problems which it was designed to solve. First, the ball must be made to rotate in a forward and downward direction, i.e., along an axis which is horizontal and perpendicular to the direction of motion. This rotation, shown in FIG. 4, causes the ball to roll in the desired direction down the alley. Secondly, the ball should have a component of rotation (called "spin") along a vertical axis, counterclockwise as viewed from above (if thrown with the right hand). This "spin", shown in FIG. 5, is largely responsible for achieving a desired scattering of the pins as they fall.

Many students of the bowling art have recognized that the middle two fingers, which occupy adjacent holes in the ball, should be the source of the desired roll. These fingers should rotate the underside of the ball upward, an effect called "lift", as they leave the ball upon release. In order for this to occur in a smooth manner the bowler's thumb must come out of the ball first. But at the same time the hand should be turning the ball to impart spin. Bowlers commonly have had great difficulty in smoothly accomplishing these aims.

Figure 6:
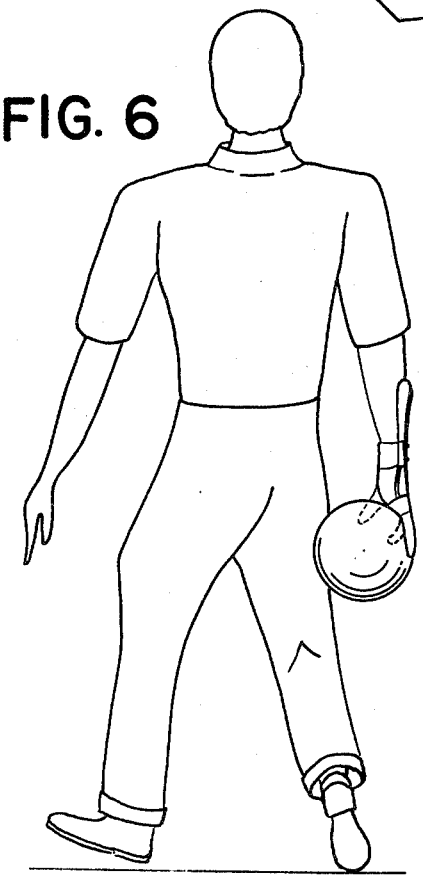
FIG. 6 is a perspective view of a bowler from the back.
Figure 7:
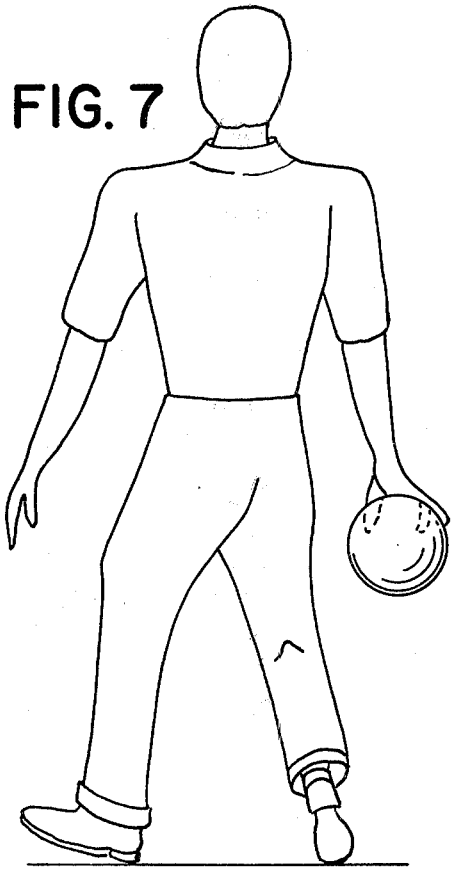
FIG. 7 is another perspective view of a bowler from the back.

In approaching the release of the ball, the bowler's thumb should be maintained in a higher position than the middle fingers. The best position for the ball is therefore not directly below the hand, but partly beside it and to the inside (as in FIG. 5). The value of supporting the wrist can be seen by comparing FIG. 6 to FIG. 7, in which the wrist is bent backward by the weight of the ball. But a straight wrist is not enough. Our studies have shown that if the index finger is permitted to bend backward near the moment of release, the thumb cannot be extracted from the ball most efficiently, and moreover the hand lacks sufficient control to impart spin to the ball.

The solution which our invention makes possible is to control simultaneously both the straightness of the wrist and the angle of the index finger with respect to the hand. The supported index finger is thus enabled to partially support and balance the ball. Equally importantly, it acts as a fulcrum. The ball can be tilted easily at the desired moment off the index finger and onto the middle fingers thereby automatically both extracting the thumb and giving spin to the ball.

It will be apparent from the foregoing that many variations and modifications may be made in the device described herein without substantially departing from the essential concept of the present invention. Accordingly, it should be understood that the form of the invention described herein and depicted in the drawings, is exemplary only and is not intended as a limitation in the scope of the present invention.

We claim:

1. A wrist and forefinger support for a bowler, comprising a rigid support body provided with a layer of resilient material between said support body and said bowler's hand, said rigid support body adapted to extend dorsally from said bowler's forefinger to a location on his forearm above his wrist, and having a proximal and a distal portion, said distal portion extending over the entire length of said bowler's forefinger only, and being cylindrically curved concavely downward so that it curves generally around, and partially encases, the forefinger, said proximal portion having a hand covering portion covering said bowler's hand and a wrist covering portion covering his wrist, said hand covering portion being transversely widened to cover essentially the entire dorsal surface of the bowler's hand, including the area extending from the base of the little finger to the base of the forefinger, said proximal portion extending dorsally over a portion of said bowler's forearm, and curving cylindrically to fit generally around said hand, wrist and forearm;

strap means to secure said support body firmly but removably against said bowler's hand and wrist;

said support means and strap means being so constructed as to restrict the backwards movement of said bowler's hand to a range of from and including zero degrees, with respect to the axis of said bowler's forearm, up to five degrees forward, and being so constructed as to restrict the backwards movement of said bowler's forefinger to an optimal angular range of 15 to 20 degrees forward, with respect to the axis of said bowler's hand.

* * * * *